US011982029B2

(12) United States Patent
O'Haire et al.

(10) Patent No.: US 11,982,029 B2
(45) Date of Patent: May 14, 2024

(54) ENGINEERED SHOE OR APPAREL

(71) Applicant: adidas AG, Herzogenaurach (DE)

(72) Inventors: Tom O'Haire, Nuremberg (DE); Andrew Yip, Nuremberg (DE)

(73) Assignee: adidas AG, Herzogenaurach (DE)

( * ) Notice: Subject to any disclaimer, the term of this patent is extended or adjusted under 35 U.S.C. 154(b) by 0 days.

(21) Appl. No.: 18/055,707

(22) Filed: Nov. 15, 2022

(65) Prior Publication Data

US 2023/0070981 A1 Mar. 9, 2023

Related U.S. Application Data

(62) Division of application No. 16/246,221, filed on Jan. 11, 2019, now Pat. No. 11,499,253.

(30) Foreign Application Priority Data

Jan. 12, 2018 (DE) ..... 10 2018 200 453.6

(51) Int. Cl.

| | |
|---|---|
| ***D04C 1/02*** | (2006.01) |
| ***A43B 1/04*** | (2022.01) |
| ***A43B 23/02*** | (2006.01) |
| ***D04C 1/06*** | (2006.01) |
| *D04C 3/08* | (2006.01) |
| *D04C 3/40* | (2006.01) |
| *D04C 3/42* | (2006.01) |
| *D04C 3/46* | (2006.01) |
| *D04C 3/48* | (2006.01) |

(52) U.S. Cl.

CPC ..... *D04C 1/02* (2013.01); *A43B 1/04* (2013.01); *A43B 23/0205* (2013.01); *A43B 23/0245* (2013.01); *D04C 1/06* (2013.01); *D04C 3/08* (2013.01); *D04C 3/40* (2013.01); *D04C 3/42* (2013.01); *D04C 3/46* (2013.01); *D04C 3/48* (2013.01); *D10B 2501/043* (2013.01)

(58) Field of Classification Search

CPC ..... D04C 1/02; D10B 2501/043; A43B 1/04

See application file for complete search history.

(56) References Cited

U.S. PATENT DOCUMENTS

| | | | |
|---|---|---|---|
| 8,757,038 | B2 | 6/2014 | Siegismund |
| 2005/0051227 | A1 | 3/2005 | Hagiwara et al. |
| 2005/0283220 | A1 | 12/2005 | Gobran et al. |
| 2013/0125739 | A1 | 5/2013 | Atsushi |

(Continued)

FOREIGN PATENT DOCUMENTS

| | | | |
|---|---|---|---|
| CH | 79635 | A | 12/1918 |
| DE | 662170 | C | 7/1938 |

(Continued)

OTHER PUBLICATIONS

Extended European Search Report issued in European Application No. 19150974.4 dated Jun. 27, 2019, 8 pages.

*Primary Examiner* — Shaun R Hurley

(74) *Attorney, Agent, or Firm* — Sterne, Kessler, Goldstein & Fox P.L.L.C.

(57) ABSTRACT

A method of producing a component for an article of footwear or apparel or a sporting goods accessory. The method of producing a component includes forming at least a first layer by braiding a first braided tube. Braiding may be performed with an empty braiding center. The method further includes arranging the first layer on a form.

14 Claims, 7 Drawing Sheets

(56) References Cited

U.S. PATENT DOCUMENTS

Figure 1A:
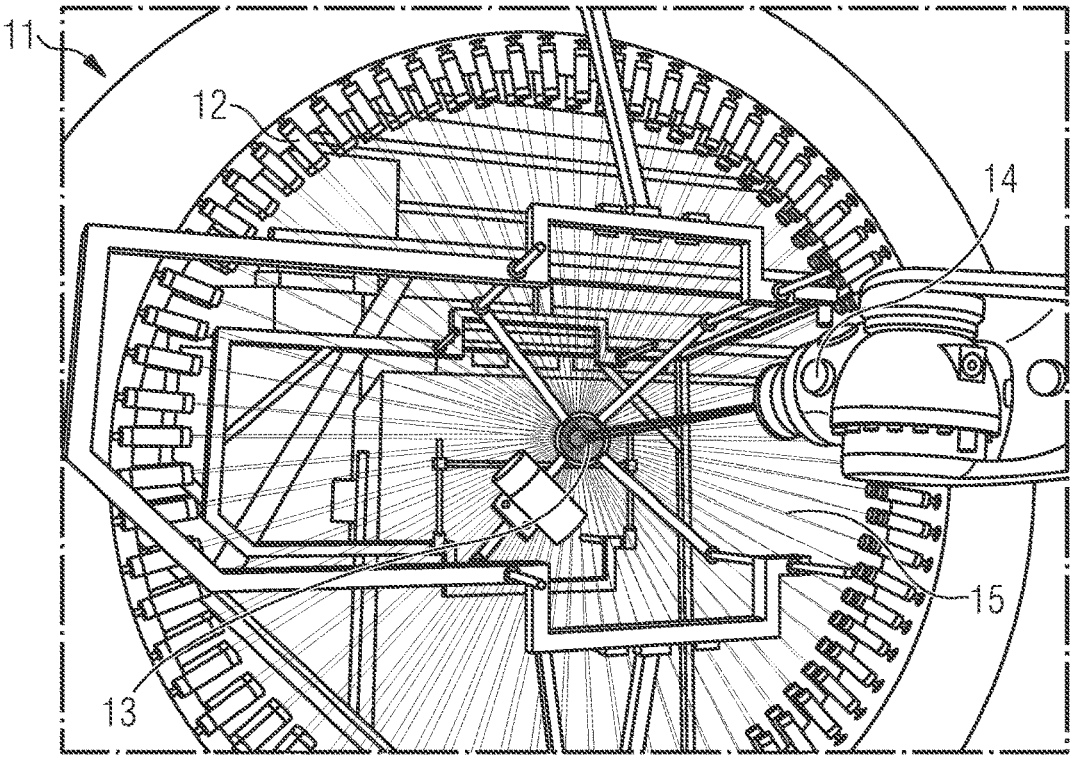

| | | | | |
|---|---|---|---|---|
| 2014/0373389 | A1 | 12/2014 | Bruce | |
| 2014/0377488 | A1 | 12/2014 | Jamison | |
| 2015/0007451 | A1 | 1/2015 | Bruce | |
| 2015/0052778 | A1* | 2/2015 | Kirk | A43B 1/04 442/204 |
| 2015/0201707 | A1 | 7/2015 | Bruce | |
| 2016/0122916 | A1 | 5/2016 | Fathallah et al. | |
| 2016/0166007 | A1 | 6/2016 | Bruce et al. | |
| 2016/0166010 | A1 | 6/2016 | Bruce et al. | |
| 2016/0206042 | A1* | 7/2016 | Cross | A43B 1/04 |
| 2016/0295971 | A1* | 10/2016 | Arnese | A43B 13/026 |
| 2016/0345674 | A1 | 12/2016 | Bruce et al. | |
| 2016/0345675 | A1 | 12/2016 | Bruce et al. | |
| 2016/0345676 | A1 | 12/2016 | Bruce et al. | |
| 2016/0345677 | A1 | 12/2016 | Bruce et al. | |
| 2018/0057982 | A1 | 3/2018 | Qiu et al. | |
| 2018/0368510 | A1 | 12/2018 | O'Haire et al. | |
| 2019/0014854 | A1 | 1/2019 | Santos et al. | |
| 2019/0030832 | A1 | 1/2019 | Fukuyama | |
| 2019/0032255 | A1 | 1/2019 | Harris | |
| 2019/0211482 | A1 | 7/2019 | Kaing et al. | |
| 2019/0329486 | A1 | 10/2019 | Goulet | |
| 2020/0232132 | A1 | 7/2020 | Fukuyama | |

FOREIGN PATENT DOCUMENTS

| | | | |
|---|---|---|---|
| DE | 102014016832 | B3 | 1/2016 |
| EP | 3 420 835 | A1 | 1/2019 |

* cited by examiner

ENGINEERED SHOE OR APPAREL

CROSS-REFERENCE TO RELATED APPLICATION

This application is a divisional of U.S. patent application Ser. No. 16/246,221, filed Jan. 11, 2019, titled "Engineered Shoe or Apparel," the disclosure of which is incorporated herein in its entirety by reference thereto. U.S. patent application Ser. No. 16/246,221 claims priority to German Patent Application No. 10 2018 200 453.6, filed Jan. 12, 2018.

TECHNICAL FIELD

The present invention relates to a component for an article of footwear or apparel, or a sporting goods accessory and a method for manufacturing the same.

PRIOR ART

A component for an article of footwear, for example an upper, or for an article of apparel has to strike the right balance between comfort, support, durability, weight, permeability to water, cost, and other factors.

Engineered knits and weaves can be used to vary the stiffness of a shoe or an article of apparel by varying the knit and weave structure. Braiding, however, allows a geometric arrangement and a variety of braids to be used to achieve a performance and level of tunability that is not possible with engineered knits or weaves.

A shoe upper can be manufactured by inserting a shoe last into a braiding machine and braiding over the last whilst guiding the last through the braiding machine. Another way of producing a braided upper for an article of footwear is by braiding over a forming mandrel located in proximity to the braiding zone, also known as the braiding point, of a braiding machine.

U.S. Pat. No. 8,757,038 B2 discloses a method for producing an upper part of a shoe, in particular a sport shoe. The method entails supplying a shoe last, which corresponds to the inner shape of the upper part of the shoe to a radial braiding machine having an annular creel, which is designed for weaving and/or braiding along three axes; guiding the at least one shoe last through the center of the creel and simultaneously weaving and/or braiding along three axes using a fiber material around the outer circumference of the shoe last; and terminating the weaving and/or braiding and removing the woven and/or braided material from the shoe last.

US 2016/0345677 A1 discloses a braiding machine and a method of forming an upper that includes braiding over a forming last that passes from a first side of a braiding point to a second side of the braiding point.

US 2016/0166007 A1 discloses a method of making an article of footwear including temporarily attaching a midsole structure to a last and inserting the midsole structure and footwear last through a braiding machine. A braided structure in the form of an upper is formed. The upper includes a midsole structure disposed within an interior cavity of the upper.

US 2016/0345676 A1 discloses a method of forming a braided upper comprising: locating a forming mandrel above a braiding point of a braiding machine; braiding a plurality of strands to form a three-dimensional braided component; pulling the braided component over the forming mandrel; and inserting a last into the braided component to shape the braided component.

US 2016/0345674 A1 discloses an article of footwear that is formed from multiple braided components. The braided components may be braided strands formed from different tensile elements. The tensile elements may have different cross-sections. The tensile elements may be from different materials. Different braided strands may then be over-braided over a last to form a braided upper for the article of footwear.

US 2016/0345675 A1 discloses an upper for an article of footwear that is formed by incorporating different braided portions. The upper may be formed by incorporating a first braided portion with a second braided portion. The top portion of the upper may have the first braided portion. The lower portion of the upper may have the second braided portion.

US 2015/0007451 A1 discloses an article of footwear including a braided upper comprised of a unitary braided structure. The unitary braided structure of the braided upper may be engineered with specific features tailored to particular activities. Different regions of the upper may have different braided configurations. For example, higher braid densities may be used in specific areas of the footwear to provide additional structural support or compression. Also, strands of a different material may be incorporated in different regions of the braided upper to provide specific properties to the footwear in those areas.

These existing methods for producing a braided shoe upper have several disadvantages however. The process of braiding over a shoe last or a forming mandrel is slow and mechanically complicated due to the complex shape of a shoe last or forming mandrel. The cost of these production methods is therefore high because the daily output of an expensive braiding machine, which usually also has a large footprint in terms of the area that is required to host such a machine, is rather low. Furthermore, expensive shoe lasts have to be produced to cover every shoe size and style.

Another disadvantage of the existing methods is that it is difficult to modularize the production process since the shoe lasts and the braiding machine have to be in the same physical location. As a further consequence, it is difficult to produce individually customized components with the existing methods. Furthermore, a braided component produced according to the existing methods cannot be used for applications outside of footwear in a straightforward manner.

An objective of the present invention is to produce a braided component with low weight and high mechanical performance that can be engineered such that it has a range of applications in apparel and footwear with only minor modifications required. The engineering should also allow a more modular production process such that a product based on the braided component can be more easily individually customized than with existing methods. Furthermore, the production method should be faster and more cost-effective than existing methods.

SUMMARY OF THE INVENTION

This objective is at least partially achieved by a method of producing a component for an article of footwear or apparel or a sporting goods accessory, comprising: forming at least a first layer by braiding a first braided tube, wherein braiding is performed with an empty braiding center; and arranging the first layer on a form.

Braiding is the interlacing of three or more yarns in such a way that they cross one another and are laid together in a non-parallel formation, forming a narrow strip of flat or tubular structure. The yarns used for braiding will be referred to as braiding yarns herein. The braiding yarns may have a non-circular cross-section, for example a lenticular shape. For example, the yarns may have an ellipsoidal cross-section. A ribbon or a tape could also be used alternatively or additionally to a yarn.

Any braiding machine can be used to construct the tube. A so-called "maypole braider" where the yarn packages are mounted in a ring around a braiding aperture could be used. Alternatively, a "radial braider" could be used wherein the braiding yarn packages are mounted radially around the braiding zone. Such an arrangement minimizes the total footprint of the device. Alternatively, the braiding machine may be a 3D braiding machine. A 3D braiding machine involves the mounting of the yarn packages in a Cartesian grid arrangement where the direction of yarns is not necessarily linear. In a 3D braiding machine, the yarn packages are free to move in a two-dimensional plane, as opposed to maypole or radial braiding machines, where the yarn packages' motion is constrained to predefined orbits around the braiding zone. In this arrangement, the shape and construction of the braid can be strongly influenced by the programmable movement of yarns. This has the advantage of being able to place yarns in a way that is not possible with other braiding machines such as radial braiding machines or axial (maypole) braiding machines.

On a braiding machine with N yarn carriers, it is usually possible to use up to N different types of yarn. The method may comprise winding at least two different types of yarn on at least one yarn carrier. Therefore, it is possible to use more than N different types of yarn on an N-carrier braiding machine, thus improving the degree to which the component can be engineered. For example, by winding M different yarns on each of the N carriers, it is possible to use N×M different types of yarn.

In the context of the present invention, braiding with an empty braiding center means braiding without a form at the braiding center. In particular, braiding with an empty braiding center means not braiding over a forming mandrel or a shoe last at the braiding center. Braiding with an empty braiding center may involve a ring located around the braiding center to guide the yarns. The ring may be located on an outer side of the braided tube during braiding.

The selection of yarns and the number of yarn packages used in the braiding setup will determine a default diameter of the resulting braided tube and prevent the tube from collapsing. For a given braiding angle, the yarn diameter needed and the number of yarn packages utilized are interdependent and inversely-related. The fewer yarn packages used for braiding, the higher the tex or denier value of the yarn needs to be. The opposite is also true, with a finer yarn requiring more yarn packages in order to establish the same resting diameter of the tube.

The filling space or cover factor of a yarn is the volume of the yarn. This filling space dictates the density of the tube wall. When the filling space is too small, the density of the tube is too small and a forming mandrel would be required. When a filling space is large enough, the engineered tube may be able to maintain its shape already during the braiding (and afterwards, even without requiring further treatment), thus removing the need for a forming mandrel or for braiding over a shoe last. Therefore, the speed of production of the component can be increased and the cost of a component and the corresponding final product can be decreased relative to a component produced with existing methods. Another advantage compared with braiding over a last is that the modularity of the production process is increased. For example, one or more braided components could be wound on a spool and transported for further assembly elsewhere. The component could also be used for producing only part of an upper, for instance, a tubular region with a high stiffness in a radial direction. Moreover, the inventors have found that more than one size of an article of footwear or apparel can be produced from only a single size of the component. For example, up to three subsequent sizes of a shoe, for example sizes 40, 41, 42 in the European system, could be manufactured from a single size of the component.

It is possible that the braided tube is cut open after braiding to form a two-dimensional braided sheet. Therefore, the final product does not have to comprise a tubular structure. Here, a tubular structure, or tube, is taken to mean a cylinder-like structure that may comprise deviations from a mathematically perfect cylinder. Said deviations may be deliberately incorporated or based on technical imperfections in the manufacturing process.

The component according to the present invention is lightweight, breathable, comfortable, yet allows sufficient support, for example for a foot, to be provided. In particular, the braided tube, and thus the component, may offer a good level of tensile strength. The properties of the braid can be engineered, for example, by a suitable choice of yarn and braiding angle. The braiding angle is the angle between a direction of the braiding yarns and the braiding direction. A region with a low braiding angle, preferably between 15° and 45°, is radially easy to expand, and can allow for expansion during a dynamic movement. A region with a high braiding angle, preferably between 46° and 80°, on the other hand is radially less extensible and stiffer. At a very high braiding angle, the braided yarns are jammed in a non-axial direction. Jamming is the point at which there is no more natural expansion from a structural aspect of the braid and further expansion is linked to the strain of the filaments and yarns within it. This jamming can be used in regions where stability is required to complement or replace reinforcement structures.

The tube can also be engineered to provide at least two different regimes of stress-strain response. In the first regime, the tube obeys a substantially linear stress-strain relationship, here the material is substantially elastic, or compliant, and when the tube is pulled the restoring force is substantially proportional to the extension from equilibrium. In the first regime, the tube behaves substantially similar to a spring that obeys Hooke's law. In the second regime, the tube obeys a substantially non-linear stress-strain relationship and the restoring force increases more rapidly with an extension from equilibrium than in the first regime. The transition point between these two regimes can be referred to as "lock-out". This behavior can have an advantageous technical effect in apparel or footwear. For example, the first regime can be engineered such that the player can comfortably get his foot into a shoe comprising the component and the component is sufficiently elastic to allow the player to run comfortably but the component is engineered such that when the player wants to change direction the shoe is stiff and provides a sufficient level of support for the player's foot.

There are other key benefits of the component. It is possible to use radically different types of braiding yarn in close proximity to one another without disturbing the manufacturing stability of the braided tube, thus allowing the properties of the component to be tuned locally. Radically different yarns are yarns whose properties differ significantly. These properties comprise, for example, composition, tex value, elasticity, bending stiffness, coating, cross-sectional area, and melt yarn content. This is a distinct advantage over braided component produced through weaving or knitting, where this would not be possible. In weaving or knitting, the use of radically different yarns would cause defects such as puckering. Furthermore, yarns have to be more flexible in knitting because the yarns themselves are bent in the knitting process. With braiding, the yarns are not bent during the braiding process so yarns could be stiffer and therefore a greater variation of yarns can be used. Furthermore, in weaving and knitting the choice of yarn is often determined by needle gauge or reed density. Thus, it would be difficult to mix fine and coarse yarns. With braiding, each package is completely independent, there are no common eyelets or "gauges" that the yarn needs to pass through. The only requirement is that the yarns can pass over and under each other with some frictional contact.

The method may further comprise sealing a first end of the first braided tube prior to arranging the first layer on the form. This enables an easier arrangement of the first layer on the form. "Sealing" is to be understood as "closing". Sealing may comprise any suitable technique known in the art and any suitable technique disclosed herein such as, for example, heating, melting a meltable material, and dissolving a soluble portion.

The component may be a portion of a shoe upper and the form may be a shoe last and the method may further comprise conforming the component to the shape of the shoe last. A shoe upper needs to be lightweight, breathable, yet sufficiently strong to provide the required support for a foot. Therefore, a component according to the present invention is ideally suited for forming a portion of a shoe upper. Another advantage of the present invention is that a shoe upper formed by a method according to the present invention is "naturally" stiffer in the heel region, where more support is required, than in a toe region, where more flexibility is usually desired. The reason for this is that when the first braided tube, and possibly the second braided tube, is pulled over the shoe last, the braided tube is stretched most in the heel region of the upper to conform to the geometry of the last thus increasing the braiding angle in that region and increasing the stiffness. A shoe may be any article of footwear, for example a football boot, a running shoe, a hiking boot, a basketball boot, a tennis shoe, etc.

Conforming the component to the shape of the form may comprise heating a part of the component. Heating the component in order to conform it to the shape of the form is advantageous as it can be easily automatized and does not rely on additional materials, for example glue being applied.

The method may further comprise sealing a second end of the first braided tube after conforming the component to the shape of the shoe last. "Sealing" is to be understood as "closing". Here, the second end of the first braided tube is not identical to the first end of the first braided tube. This way, the shaped first braided tube is consolidated. In other words, after sealing the second end of the first braided tube, the conformed shape of the first braided tube becomes more permanent and stable. Sealing may comprise any suitable technique known in the art and any suitable technique disclosed herein such as, for example, heating, melting a meltable component, and dissolving a soluble portion.

The method may further comprise cutting open a collar opening into the shoe upper to allow entry of a foot. This way, the shoe upper conforms better to the shape of a foot. The last may also be removed from the lasted shoe upper through the opening. Alternatively, the second end of the first braided tube and the second end of the shoe upper may not be sealed and the second end may serve as a collar opening for entry of a foot. In the latter case, it is not necessary to cut a collar opening thus reducing the number of necessary process steps.

The braided tube may be braided biaxially. In the context of the present invention, a biaxially braided tube is a braided tube that does not have an axial yarn incorporated during braiding. An axial yarn, sometimes also known as a standing yarn, or a longitudinal yarn, runs along an axial (also denoted as longitudinal) direction of the tubular structure. However, note that it is possible to incorporate additional yarns, for example by stitching or sewing, after braiding. An axial yarn is not referred to as a braiding yarn in the context of the present invention. A braided tube that comprises both braiding yarns and at least one axial yarn is commonly referred to as a triaxial braided tube.

An advantage of braiding biaxially rather than triaxially is that the speed of braiding is increased significantly. Moreover, the inventors have found that a biaxial tube is more stretchable (for a given type of yarn) and conforms better to the form in the second method step, thus allowing for a better fit.

According to an important aspect, the method may further comprise: forming a second layer; and arranging the second layer on the form. This allows the functionality and comfort of the component to be improved. For example, the first layer may be designed to provide good wearing comfort to the wearer, while the second layer may be designed to provide a strong "cage". The first layer and the second layer need not be arranged on top of each other. For example, the first and the second layers may be arranged end-to-end. For example, it is possible that good support is required in a particular region of the shoe upper, for example the heel region, while greater wearing comfort is required in another region, for example the midfoot region.

The method may further comprise overlapping the first layer and the second layer at at least one overlapping point. This allows the properties of the first layer and the second layer to complement each other in a beneficial manner at the overlapping point.

The method may further comprise connecting the first layer to the second layer at at least one connection point. By connecting the first layer to the second layer at at least one connection point, the overall stability of the component is improved. The first layer may be connected to the second layer at the connection point by any suitable method, for example gluing or sewing.

For example, the first layer and the second layer may be connected end-to-end prior to arranging the first layer and the second layer on the form. Arranging the first layer on a form and arranging the second layer on the form is thus simplified. The first layer is pulled over the form pulling the second layer also over the form. It is also easier to connect the first layer and the second layer prior to arranging the first layer and the second layer on the form, allowing for a strong connection to be made.

The first layer and/or the second layer may comprise at least one meltable material. In particular, the first layer and/or the second layer may comprise yarns having the at least one meltable material. In one embodiment, only a single layer, e.g. the first layer, is formed, e.g. by braiding a first braided tube, wherein the single layer comprises yarns having the at least one meltable material. The meltable yarns may be used to fuse and stabilize the different yarns of the single layer.

Furthermore, the first layer may be connected to the second layer at the connection point, wherein said connection may comprise melting the meltable material. This way, it is possible to connect the first layer to the second layer and to consolidate the braid without the need for adhesives or solvents, which is environmentally friendly and preferable from a health-and-safety point of view. Preferably, the meltable material melts at a temperature of less than 100° C., more preferably less than 80° C., in order to prevent damage to the other yarns in the component. For example, one or more braiding yarns may be a melt yarn, sometimes also referred to as a fuse yarn. A fuse yarn may have a core with a high melting temperature which is coated with a material with a lower melting temperature.

The method may, alternatively or additionally, comprise applying at least one additional tape, film, or patch comprising a meltable material to the first layer and/or the second layer and melting the meltable material in the tape, film, or patch.

The method may comprise melting essentially the entire first and/or second layer. For example, essentially the entire second layer may be melted in order to consolidate the first layer. This way, a particularly good stability of the component can be achieved. However, it is also possible that only a part of the first layer and/or the second layer is melted.

The first and/or the second layer may comprise a soluble portion that is soluble in a solvent and the method may further comprise at least partly dissolving the soluble portion. For example, a yarn may be soluble in a solvent. At least partly dissolving the soluble portion should comprise a suitable amount of solvent, determined by the solubility of the soluble portion in the solvent, to ensure that the soluble portion, when dissolved in the solvent, is not lost during the procedure but stays in contact with the first and/or second layer. Some loss, however, may be inevitable in practice. "Dissolving" in this context therefore does not mean that the first and/or second is actually removed from the component. This method allows the first and/or second layer to be consolidated easily.

The method may comprise providing a coated yarn comprising a coating that is soluble in the solvent and a core that is not soluble in the solvent. This way, the dissolved coating provides consolidation but the non-soluble core is not dissolved by the solvent. This improves the structural strength of the first and/or second layer.

The method may comprise at least partly dissolving essentially the entire surface of the first and/or second layer. For example, essentially the surface of the entire second layer may be dissolved in order to consolidate the first layer. This way, a particularly good stability of the component can be achieved. "Essentially" in this context is to be understood such that a non-dissolvable core of a yarn remains and some parts of the surface of the first and/or second layer may not be dissolved due to imperfections in the process. However, it is also possible that only a part the surface of the first layer and/or the second layer is dissolved.

At least partly dissolving the soluble portion may be done at temperatures of 70°-100° C. to increase the solubility of the soluble portion in the solvent.

The solvent may be water. Water is non-toxic and safe to use even on a large scale. A water-soluble yarn could comprise poly(vinyl alcohol), which has the advantage that it is not toxic and has a high solubility in water.

However, many combinations of the soluble portion and the solvent are suitable. It is only important that the soluble portion is soluble in the solvent. The solvent may be an ionic liquid or an organic solvent, depending on the material of the soluble portion. For example, alternatively, the soluble portion may comprise polycaprolactone for which a suitable solvent would be chloroform or dichloromethane, or a mixture of both. Alternatively, the soluble portion could comprise nylon for which a suitable solvent would be acetic acid.

The method may further comprise applying pressure. Pressure may be applied when the meltable material is melted. Alternatively or additionally, pressure may be applied when the soluble portion is dissolved. By application of pressure, the consolidation of the first and/or second layer may be improved. For example, the melted material and/or the dissolved soluble portion may form a film on the first and/or second layer.

The method may further comprise removing the solvent. Removing the solvent may comprise applying heat in order to accelerate evaporation of the solvent.

The second layer may comprise a second braided tube. The second braided tube may have any of the properties of the first braided tube described herein. Therefore, the second braided tube may generally offer the same benefits as the first braided tube, as described herein. Incorporating a second braided tube is advantageous as it allows different requirements for different parts of the component to be satisfied.

The first braided tube may comprise a first braiding angle at the overlapping point, the second braided tube may comprise a second braiding angle at the overlapping point, and the first braiding angle may be different than the second braiding angle. As discussed herein, the braiding angle strongly affects the ability of a braided tube to expand and thus the stiffness of the tube and the support that a component would provide, for example to a foot. The braiding angle also affects the perceived level of comfort in wearing an article of footwear or apparel that comprises a component according to the present invention. Therefore, it is advantageous to combine a first braided tube of the first braiding angle with a second braided tube of a (different) second braiding angle, in order to ideally tune the level of support and comfort provided by the component.

The first braiding angle may be larger than the second braiding angle. For a given type of yarn, the first braided tube with the first braiding angle will be less expandable and stiffer than the second braided tube with the (smaller) second braiding angle. Thus, the first braided tube may provide stability, while the second braided tube may provide wearing comfort, for example, due to an enhanced breathability due to the lower braiding density of the second braided tube.

The first braided tube may comprise a first yarn of a first type and the second braided tube may comprise a second yarn of a second type. The type of yarn, in the present context, is determined by the properties of the yarn, comprising, for example, composition, tex value, elasticity, bending stiffness, coating, cross-sectional area, and melt yarn content. Thus, it is possible to enhance or compensate the different properties of the first braided tube and the second braided tube that may, for example, be afforded by different braiding angle.

The first yarn of the first type may have a first elastic modulus and the second yarn of the second type may have a second elastic modulus, and the second elastic modulus may be greater than the first elastic modulus. An elastic modulus may also be referred to as a Young's modulus. A material with a large elastic modulus requires a large force along a direction for an extension by a unit distance along the direction. As the second elastic modulus may be greater than the first elastic modulus, it is possible, for example, to compensate for the greater stiffness that would, generally, the afforded by the first braiding angle that is larger than the second braiding angle. Thus, it is possible that the first braided tube, i.e. the first layer, may be less stiff than the second braided tube, i.e. the second layer, even if the first braiding angle is larger than the second braiding angle.

Alternatively, the first elastic modulus may be greater than the second elastic modulus. This way it would, for example, be possible to enhance the effect due to a first braiding angle that is larger than a second braiding angle.

The second layer may comprise a non-woven. In the context of the present invention, a non-woven, or nonwoven, is any material comprising fibres that are bonded together by chemical, mechanical, or thermal means, excluding woven or knitted materials. The non-woven may be formed by any known method, for example by the spun-bond or meltblown methods. A non-woven may be lightweight, breathable, and offer good water resistance. However, non-wovens may tear easily due to their low tensile strength. The combination of the first braided tube and the second layer comprising a non-woven therefore allows the properties of a braided tube, in particular its good tensile strength, and the properties of a non-woven, in particular its good level of water resistance, i.e. a low water permeability, to be combined advantageously.

The second layer may comprise a thermoplastic. Thermoplastic, in the context of the present invention, is any polymer that becomes pliable above a specific temperature and hardens upon cooling below that temperature. Thermoplastic may be useful for forming a non-woven, as it allows the fibres of the non-woven to be bonded together by thermal means, such as heating and subsequent cooling. A thermoplastic may also be useful in order to aid conforming the component to the shape of the form, for example by thermal means.

Additionally, or alternatively, the second layer may comprise any textile, such as a woven, warp-knit, or weft-knit textile.

The second layer may be arranged above the first layer. "Above" in the context of the present invention means closer to the outside of the article of footwear or apparel. For example, an outer layer is located above an inner layer of a shoe upper. In this arrangement, the first layer may provide wearing comfort to the wearer, while the second layer may provide the required stability or level of water resistance. For example, the first layer may have a large braiding angle, thus a large braiding density and the first layer may further comprise a first yarn of a small first elastic modulus. The second layer may have a small braiding angle and thus a small braiding density but comprise a second yarn of a large second elastic modulus. In this configuration, the second layer would act as a stiff "cage" and the first layer would act as a cushioning layer for wearing comfort.

The second layer may be arranged below the first layer. "Below" in the context of the present invention means closer to the inside of the article of footwear or apparel. For example, an inner layer is located below an outer layer of the shoe upper. In this arrangement, the second layer may provide wearing comfort to the wearer, while the first layer may provide structural stability, for example tensile strength. For example, the second layer may be a non-woven, which is comfortable to wear on the skin, while the first layer, comprising the first braided tube, may provide tensile strength. The first layer may also serve as protection against abrasion, for example by using strong, abrasion-resistant yarn in the first braided tube.

The invention further concerns a method of producing a shoe comprising: (a) forming a component by a method according to the invention and (b) attaching a sole element. The shoe offers the advantages of the component according to the invention described herein and the protection and stability afforded by the sole element.

The invention further concerns a component for an article of footwear or apparel or a sporting goods accessory, comprising: a first layer, wherein the first layer comprises a braided element; and a second layer.

A "braided element" may be a braided tube produced by any method described herein. A "braided element" may be a braided tube that has been cut open so that the braided element does not necessarily have a tubular structure. Here, a tubular structure, or tube, is taken to mean a cylinder-like structure that may comprise deviations from a mathematically perfect cylinder. Said deviations may be deliberately incorporated or based on technical imperfections in the manufacturing process.

Braiding is the interlacing of three or more yarns in such a way that they cross one another and are laid together in a non-parallel formation, forming a narrow strip of flat or tubular structure. The yarns used for braiding will be referred to as braiding yarns herein. The braiding yarns may have a non-circular cross-section, for example a lenticular shape. For example, the yarns may have an ellipsoidal cross-section. A ribbon or a tape could also be used alternatively or additionally to a yarn.

Any braiding machine can be used to construct the tube. A so-called "maypole braider" where the packages are mounted in a ring around a braiding aperture could be used. Alternatively, a "radial braider" could be used wherein the braiding yarn packages are mounted radially around the braiding zone. Such an arrangement minimizes the total footprint of the device. Alternatively, the braiding machine may be a 3D braiding machine. A 3D braiding machine involves the mounting of the yarn packages in a Cartesian grid arrangement where the direction of yarns is not necessarily linear. In a 3D braiding machine, the yarn packages are free to move in a two-dimensional plane, as opposed to maypole or radial braiding machines, where the yarn packages' motion is constrained to predefined orbits around the braiding zone. In this arrangement, the shape and construction of the braid can be strongly influenced by the programmable movement of yarns. This has the advantage of being able to place yarns in a way that is not possible with other braiding machines such as radial braiding machines or axial (maypole) braiding machines.

The component according to the present invention is lightweight, breathable, comfortable, yet allows sufficient support, for example for a foot, to be provided. In particular, the braided tube, and thus the component, may offer a good level of tensile strength. The properties of the braid can be engineered, for example, by a suitable choice of yarn and braiding angle. The braiding angle is the angle between a direction of the braiding yarns and the braiding direction. A region with a low braiding angle, preferably between 15° and 45°, is radially easy to expand, and can allow for expansion during a dynamic movement. A region with a high braiding angle, preferably between 46° and 80°, on the other hand is radially less extensible and stiffer. At a very high braiding angle, the braided yarns are jammed in a non-axial direction. Jamming is the point at which there is no more natural expansion from a structural aspect of the braid and further expansion is linked to the strain of the filaments and yarns within it. This jamming can be used in regions where stability is required to complement or replace reinforcement structures.

The tube can also be engineered to provide at least two different regimes of stress-strain response. In the first regime, the tube obeys a substantially linear stress-strain relationship, here the material is substantially elastic, or compliant, and when the tube is pulled the restoring force is substantially proportional to the extension from equilibrium. In the first regime, the tube behaves substantially similar to a spring that obeys Hooke's law. In the second regime, the tube obeys a substantially non-linear stress-strain relationship and the restoring force increases more rapidly with an extension from equilibrium than in the first regime. The transition point between these two regimes can be referred to as "lock-out". This behavior can have an advantageous technical effect in apparel or footwear. For example, the first regime can be engineered such that the player can comfortably get his foot into a shoe comprising the component, and the component is sufficiently elastic to allow the player to run comfortably, but the component is engineered such that when the player wants to change direction the shoe is stiff and provides a sufficient level of support for the player's foot.

There are other key benefits of the component. It is possible to use radically different types of braiding yarn in close proximity to one another without disturbing the manufacturing stability of the braided tube, thus allowing the properties of the component to be tuned locally. Radically different yarns are yarns whose properties differ significantly. These properties comprise, for example, composition, tex value, elasticity, bending stiffness, coating, cross-sectional area, and melt yarn content. This is a distinct advantage over braided component produced through weaving or knitting, where this would not be possible. In weaving or knitting, the use of radically different yarns would cause defects such as puckering. Furthermore, yarns have to be more flexible in knitting because the yarns themselves are bent in the knitting process. With braiding, the yarns are not bent during the braiding process so yarns could be stiffer and therefore a greater variation of yarns can be used. Furthermore, in weaving and knitting the choice of yarn is often determined by needle gauge or reed density. Thus, it would be difficult to mix fine and coarse yarns. With braiding, each package is completely independent, there are no common eyelets or "gauges" that the yarn needs to pass through. The only requirement is that the yarns can pass over and under each other with some frictional contact.

The combination of a first layer and a second layer allows the functionality and comfort of the component to be improved. For example, the first layer may be designed to provide good wearing comfort to the wearer, while the second layer may be designed to provide a strong "cage". The first layer and the second layer need not be arranged on top of each other. For example, the first and the second layer may be arranged end-to-end. For example, it is possible that good support is required in a particular region of the shoe upper, for example the heel region, while greater wearing comfort is required in another region, for example the midfoot region.

The component may be a portion of a shoe upper. A shoe upper needs to be lightweight, breathable, yet sufficiently strong to provide the required support for a foot. Therefore, a component according to the present invention is ideally suited for forming a portion of a shoe upper. Another advantage of the present invention is that a shoe upper formed by a method according to the present invention is "naturally" stiffer in the heel region, where more support is required, than in a toe region, where more flexibility is usually desired. The reason for this is that when the first braided tube, and possibly the second braided tube, is pulled over the shoe last, the braided tube is stretched most in the heel region of the upper to conform to the geometry of the last thus increasing the braiding angle in that region and increasing the stiffness. A shoe may be any article of footwear, for example a football boot, a running shoe, a hiking boot, a basketball boot, a tennis shoe, etc.

The braided element may be braided biaxially. In the context of the present invention, a biaxially braided tube is a braided tube that does not have an axial yarn incorporated during braiding. An axial yarn, sometimes also known as a standing yarn, or a longitudinal yarn, runs along an axial (also denoted as longitudinal) direction of the tubular structure. However, note that it is possible to incorporate additional yarns, for example by stitching or sewing, after braiding. An axial yarn is not referred to as a braiding yarn in the context of the present invention. A braided tube that comprises both braiding yarns and at least one axial yarn is commonly referred to as a triaxial braided tube.

An advantage of braiding biaxially rather than triaxially is that the speed of braiding is increased significantly. Moreover, the inventors have found that a biaxial tube is more stretchable (for a given type of yarn) and conforms better to the form in the second method step, thus allowing for a better fit.

The first layer and the second layer may overlap at at least one overlapping point. This allows the properties of the first layer and the second layer to complement each other in a beneficial manner at the overlapping point.

The first layer may be connected to the second layer at at least one connection point. By connecting the first layer to the second layer at at least one connection point, the overall stability of the component is improved. The first layer may be connected to the second layer at the connection point by any suitable method, for example gluing or sewing.

The first layer and/or the second layer may comprise at least one meltable material at the connection point. This way, the first layer and the second layer may be connected by melting the meltable material and allowing it to cool and solidify. Preferably, the meltable material melts at a temperature of less than 100° C., more preferably less than 80° C., in order to prevent damage to the other yarns in the component. For example, one or more braiding yarns may be a melt yarn, sometimes also referred to as a fuse yarn.

In an alternative configuration, the component comprises only a single layer, e.g. the first layer, which may be made by braiding a first braided tube, wherein the single layer comprises yarns having the at least one meltable material. The meltable yarns may be used to fuse and stabilize the different yarns of the single layer.

The second layer may comprise a second braided element. The second braided element may have any of the properties of the first braided element described herein. Therefore, the second braided element may generally offer the same benefits as the first braided element, as described herein. Incorporating a second braided element is advantageous as it allows different requirements for different parts of the component to be satisfied.

The first braided element may comprise a first braiding angle at the overlapping point, the second braided element may comprise a second braiding angle at the overlapping point, and the first braiding angle may be different than the second braiding angle. As discussed herein, the braiding angle strongly affects the ability of a braided element to expand and thus the stiffness of the element and the support that a component would provide, for example to a foot. The braiding angle also affects the perceived level of comfort in wearing an article of footwear or apparel that comprises a component according to the present invention. Therefore, it is advantageous to combine first braided element of the first braiding angle with a second braided element of a (different) second braiding angle, in order to ideally tune the level of support and comfort provided by the component.

The first braiding angle may be larger than the second braiding angle. For a given type of yarn, the first braided element with the first braiding angle will be less expandable and stiffer than the second braided element with the (smaller) second braiding angle. Thus, the first braided element may provide stability, while the second braided element may provide wearing comfort, for example, due to enhanced breathability due to the lower braiding density of the second braided element.

The first braided element may comprise a first yarn of a first type and the second braided element comprises a second yarn of a second type. The type of yarn, in the present context, is determined by the properties of the yarn, comprising, for example, composition, tex value, elasticity, bending stiffness, coating, cross-sectional area, and melt yarn content. Thus, it is possible to enhance or compensate the different properties of the first braided element and the second braided element that may, for example, be afforded by different braiding angles.

The first yarn of the first type may have a first elastic modulus and the second yarn of the second type may have a second elastic modulus, and the second elastic modulus may be greater than the first elastic modulus. An elastic modulus may also be referred to as a Young's modulus. A material with a large elastic modulus requires a large force along a direction for an extension by a unit distance along the direction. As the second elastic modulus may be greater than the first elastic modulus, it is possible, for example, to compensate for the greater stiffness that would, generally, the afforded by the first braiding angle that is larger than the second braiding angle. Thus, it is possible that the first braided element, i.e. the first layer, may be less stiff than the second braided element, i.e. the second layer, even if the first braiding angle is larger than the second braiding angle.

Alternatively, the first elastic modulus may be greater than the second elastic modulus. This way it would, for example, be possible to enhance the effect due to a first braiding angle that is larger than a second braiding angle.

The second layer may comprise a non-woven. In the context of the present invention, a non-woven, or nonwoven, is any material comprising fibres that are bonded together by chemical, mechanical, or thermal means, excluding woven or knitted materials. The non-woven may be formed by any known method, for example by the spun-bond or meltblown methods. A non-woven may be lightweight, breathable, and offer good water resistance. However, non-wovens may tear easily due to their low tensile strength. The combination of the first braided element and the second layer comprising a non-woven therefore allows the properties of a braided element, in particular its good tensile strength, and the properties of a non-woven, in particular its good level of water resistance, i.e. a low water permeability, to be combined advantageously.

The second layer may comprise a thermoplastic. Thermoplastic, in the context of the present invention, is any polymer that becomes pliable above a specific temperature and hardens upon cooling below that temperature. Thermoplastic may be useful for forming a non-woven, as it allows the fibres of the non-woven to be bonded together by thermal means, such as heating and subsequent cooling. A thermoplastic may also be useful in order to aid conforming the component to the shape of the form, for example by thermal means.

The second layer may be arranged above the first layer. "Above" in the context of the present invention means closer to the outside of the article of footwear or apparel. For example, an outer layer is located above an inner layer of a shoe upper. In this arrangement, the first layer may provide wearing comfort to the wearer, while the second layer may provide the required stability or level of water resistance. For example, the first layer may have a large braiding angle, thus a large braiding density and the first layer may further comprise a first yarn of a small first elastic modulus. The second layer may have a small braiding angle and thus a small braiding density but comprise a second yarn of a large second elastic modulus. In this configuration, the second layer would act as a stiff "cage" and the first layer would act as a cushioning layer for wearing comfort.

The second layer may be arranged below the first layer. "Below" in the context of the present invention means closer to the inside of the article of footwear or apparel. For example, an inner layer is located below an outer layer of the shoe upper. In this arrangement, the second layer may provide wearing comfort to the wearer, while the first layer may provide structural stability, for example tensile strength. For example, the second layer may be a non-woven, which is comfortable to wear on the skin, while the first layer, comprising the first braided element, may provide tensile strength. The first layer may also serve as protection against abrasion, for example by using strong, abrasion-resistant yarn in the first braided element.

The invention further concerns a shoe comprising a component according to the invention and a sole element. The shoe offers the advantages of the component according to the invention described herein and the protection and stability afforded by the sole element.

SHORT DESCRIPTION OF THE FIGURES

In the following, exemplary embodiments of the invention are described with reference to the figures. The figures show:

FIGS. 1A-D: an exemplary method of producing a component for an article of footwear or apparel or a sporting goods accessory according to the present invention.

Figure 2A:
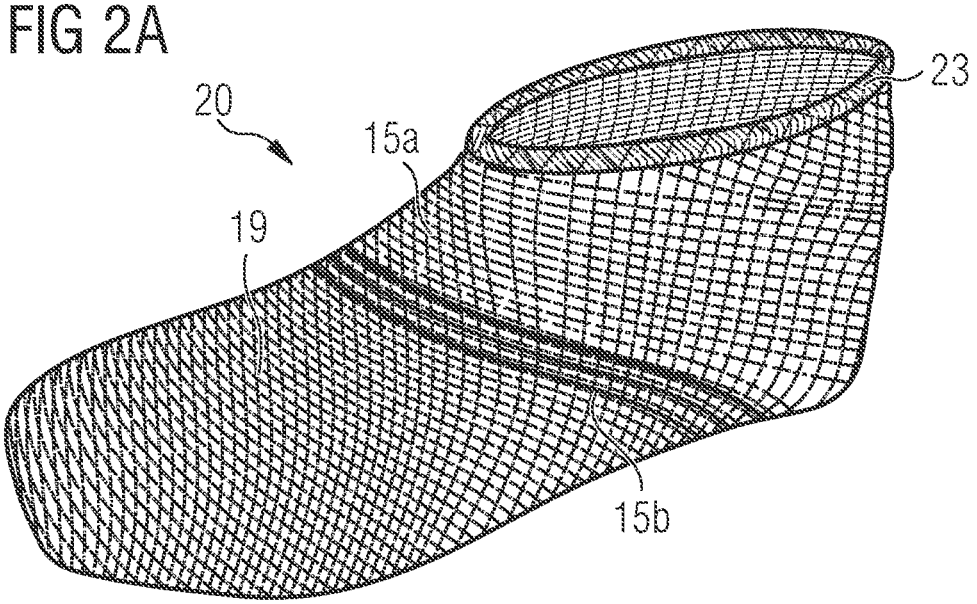

FIGS. 2A and B: an exemplary shoe upper (FIG. 2A) produced by a method according to the present invention and an exemplary shoe (FIG. 2B) produced by a method according to the present invention.

Figure 3:
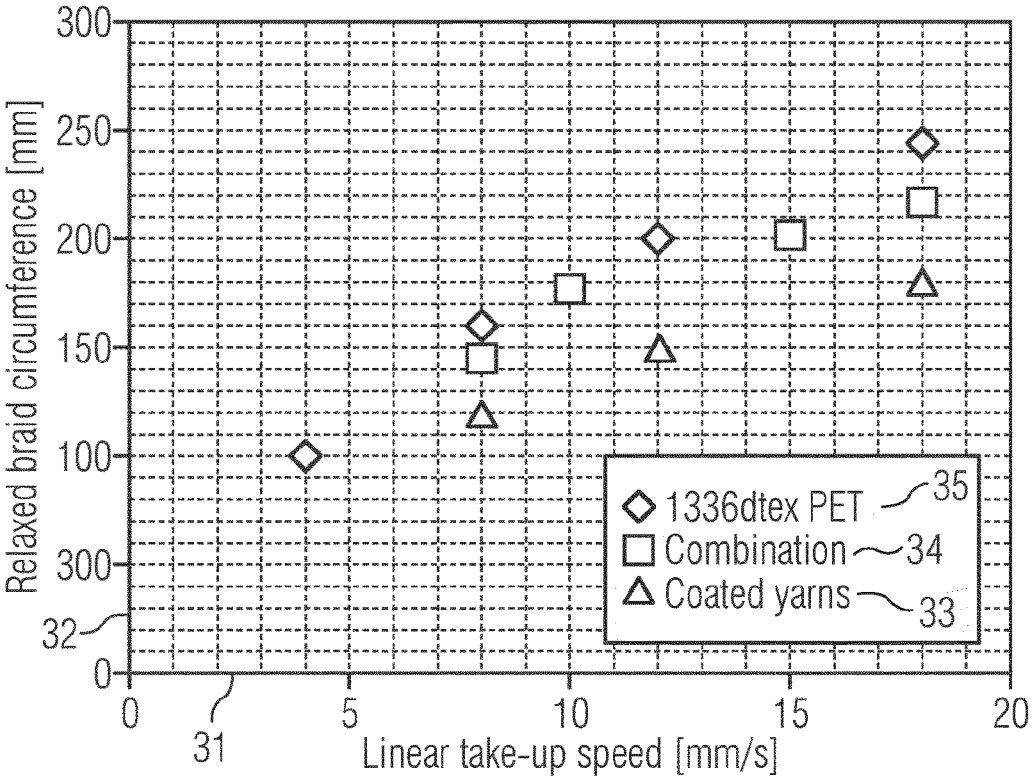

FIG. 3: an exemplary graph showing the circumference of a braided tube produced by a method according to the present invention for different production settings.

Figure 4A:
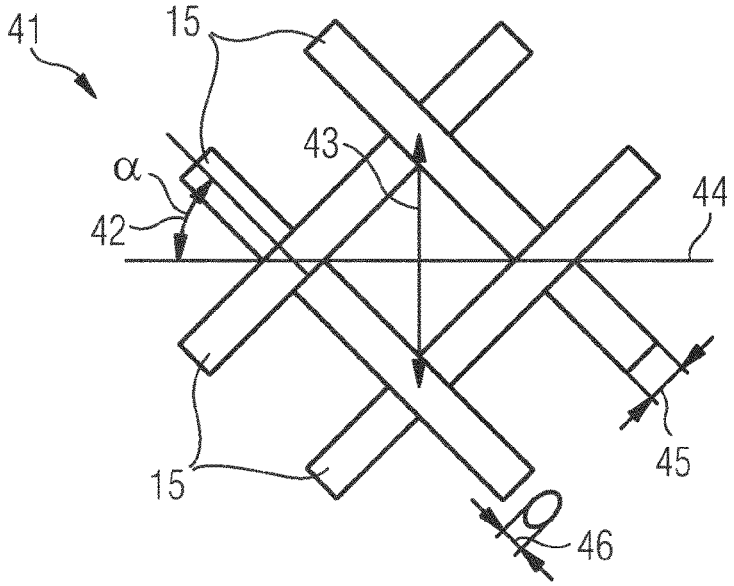
Figure 4B:
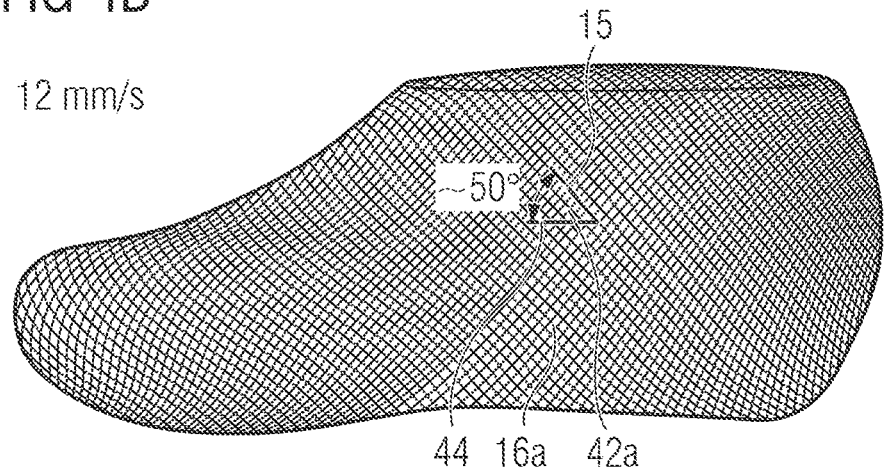
Figure 4C:
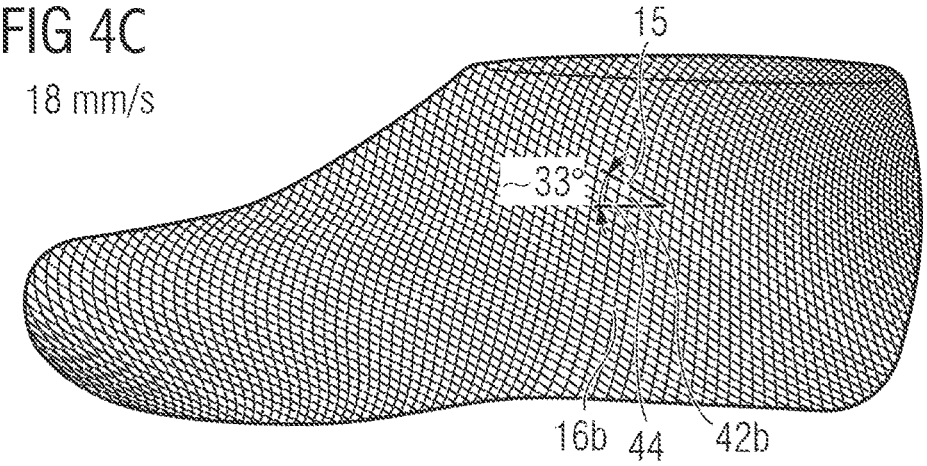

FIGS. 4A-C: an illustration of a braiding angle of a braided element (FIG. 4A) and a method for controlling the braiding angle (FIGS. 4B and 4C).

Figure 5:
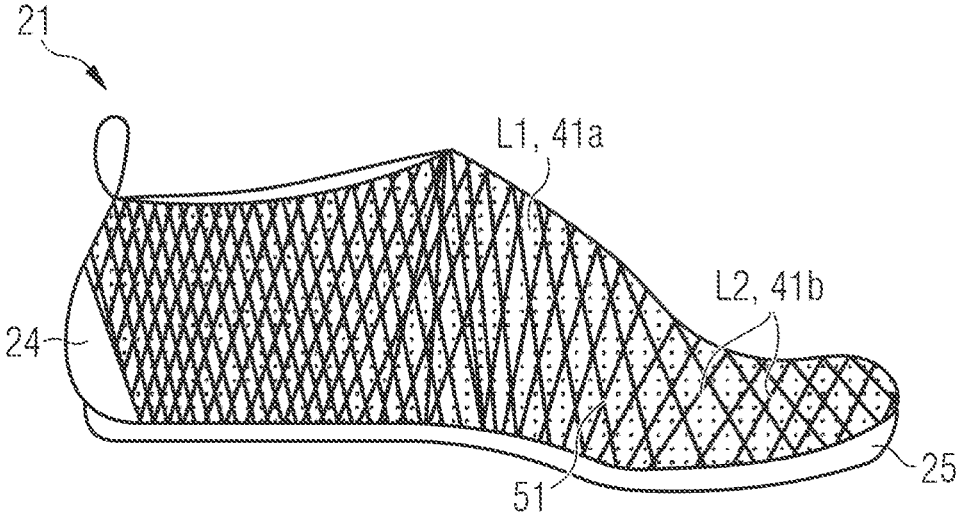

FIG. 5: an exemplary shoe comprising an exemplary component according to the present invention.

FIGS. 6*a-d*: an exemplary shoe upper and method for producing the same according to the present invention.

FIGS. 7*a-c*: an exemplary method of producing a component for an article of footwear or apparel according to the present invention.

Figure 8A:
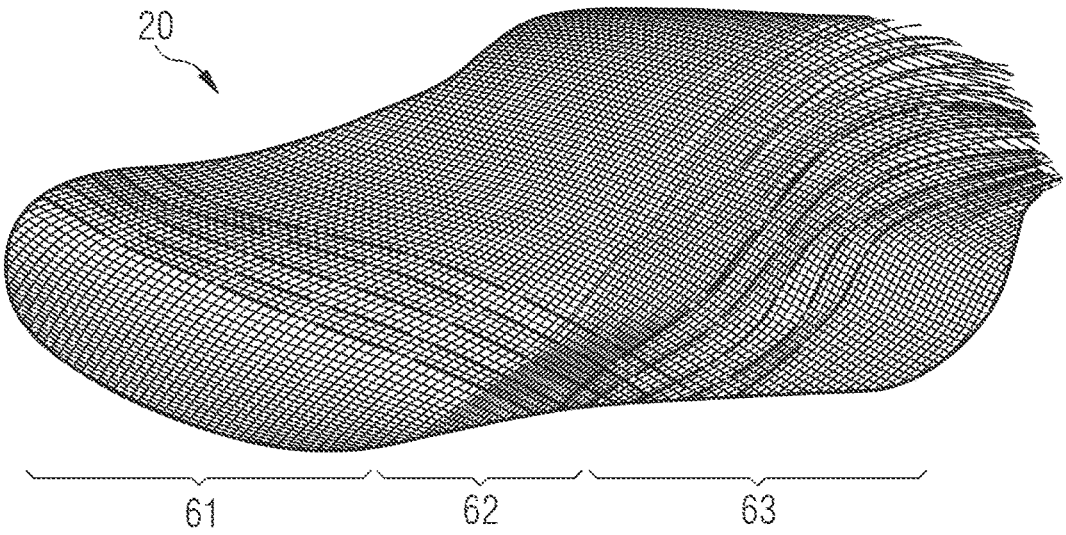
Figure 8B:
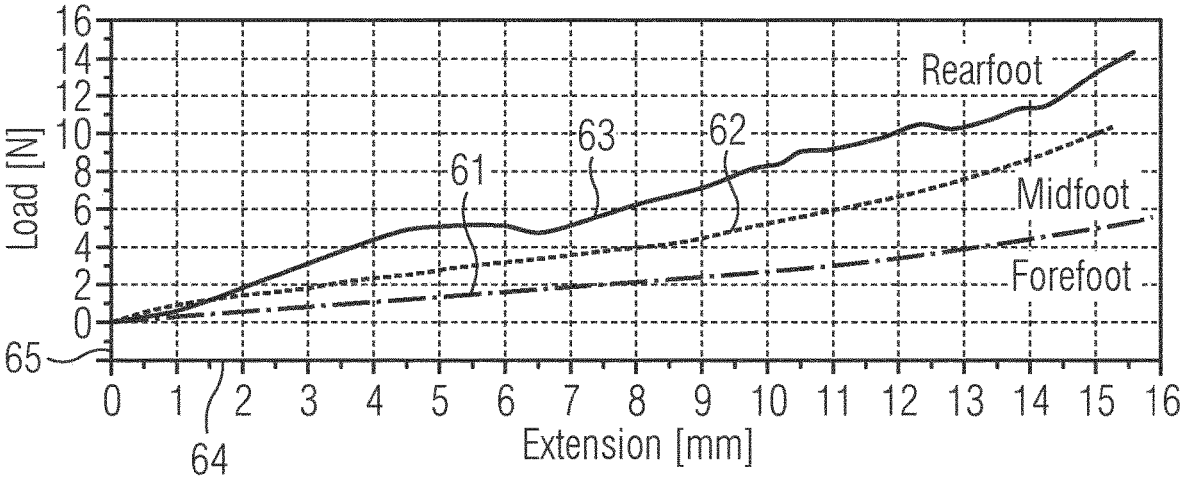

FIGS. 8A-B: an exemplary shoe upper according to the present invention.

DETAILED DESCRIPTION OF EXEMPLARY EMBODIMENTS

In the following only some possible examples of the invention are described in detail. It is to be understood that these exemplary embodiments can be modified in a number of ways and combined with each other whenever compatible and that certain features may be omitted in so far as they appear dispensable. While in the following the invention is described primarily with reference to a shoe, it should be noted that the teachings of the invention also apply to apparel, for example sleeves, shirts, gloves, hats, shinguards, etc.

FIGS. 1A-D show an exemplary method of producing a component 19 for an article of footwear or apparel or a sporting goods accessory, comprising: forming at least a first layer by braiding a first braided tube 16, wherein braiding is performed with an empty braiding center 13; and arranging the first layer L1 on a form 18.

Figure 1B:
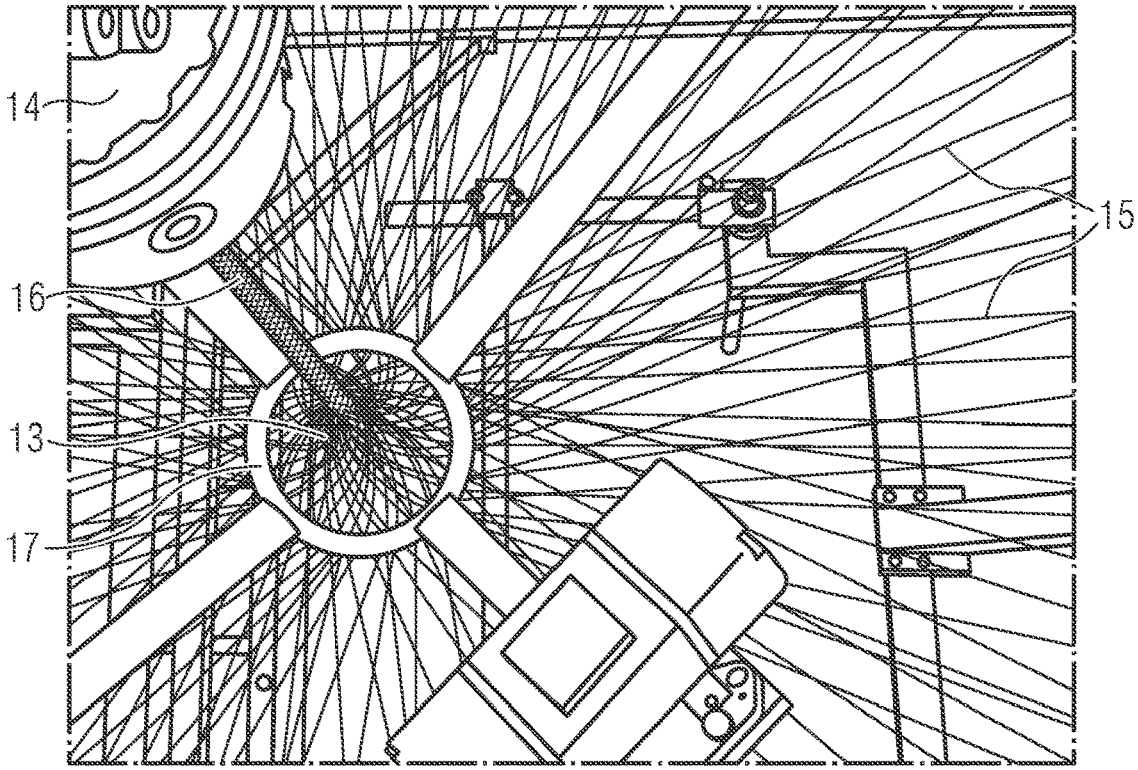

FIGS. 1A-B show an exemplary braiding machine 11 suitable for performing part of the method according to the present invention. Any braiding machine can be used to construct the tube. In this example, a "radial braider" or radial braiding machine 11 is used. The braiding yarn packages 12 are mounted radially around the braiding center 13.

In the context of the present invention, braiding with an empty braiding center 13 means braiding without a form 18 at the braiding center 13. In particular, braiding with an empty braiding center 13 means not braiding over a forming mandrel or a shoe last at the braiding center 13. Braiding with an empty braiding center 13 may involve a braiding ring 17 located around the braiding center 13 to guide the yarns 15. The braiding ring 17 may be located on an outer side of the braided tube 16 during braiding.

FIG. 1B shows a close-up around the braiding center 13. A take-up device 14 is used to pull the braided tube 16 away from the braiding center 13.

The selection of yarns and the number of yarn packages used in the braiding setup will determine a default diameter of the resulting braided tube 16 and prevent the tube from collapsing. For a given braiding angle, the yarn diameter needed and the number of yarn packages utilized are interdependent and inversely-related. The fewer yarn packages used for braiding, the higher the tex or denier value of the yarn needs to be. The opposite is also true, with a finer yarn requiring more yarn packages in order to establish the same resting diameter of the tube. For example, on a machine set up with 64 yarn packages for braiding yarns 15, braiding yarns 15 of preferably at least 12 tex, more preferably at least 18 tex, would need to be used.

The filling space or cover factor of a yarn is the volume of the yarn. This filling space dictates the density of the tube wall. When the filling space is too small, the density of the tube is too small and a forming mandrel would be required. When a filling space is large enough, the engineered tube may be able to maintain its shape already during the braiding (and afterwards, even without requiring further treatment), thus removing the need for a forming mandrel or for braiding over a shoe last. Therefore, the speed of production of the component 19 can be increased and the cost of a component 19 and the corresponding final product can be decreased relative to a component 19 produced with existing methods.

It is possible that the braided tube 16 is cut open after braiding to form a two-dimensional braided sheet. The term "braided element" comprises both a braided tube and a two-dimensional braided sheet. Therefore, the final product does not have to comprise a tubular structure. Here, a tubular structure, or tube, is taken to mean a cylinder-like structure that may comprise deviations from a mathematically perfect cylinder. Said deviations may be deliberately incorporated or based on technical imperfections in the manufacturing process.

The braided tube 16 is braided biaxially. In the context of the present invention, a biaxially braided tube 16 is a braided tube 16 that does not have an axial yarn incorporated during braiding. An axial yarn, sometimes also known as a standing yarn, or a longitudinal yarn, runs along an axial (also denoted as longitudinal) direction of the tubular structure. However, note that it is possible to incorporate additional yarns, for example by stitching or sewing, after braiding. An axial yarn is not referred to as a braiding yarn 15 in the context of the present invention.

Figure 1C:
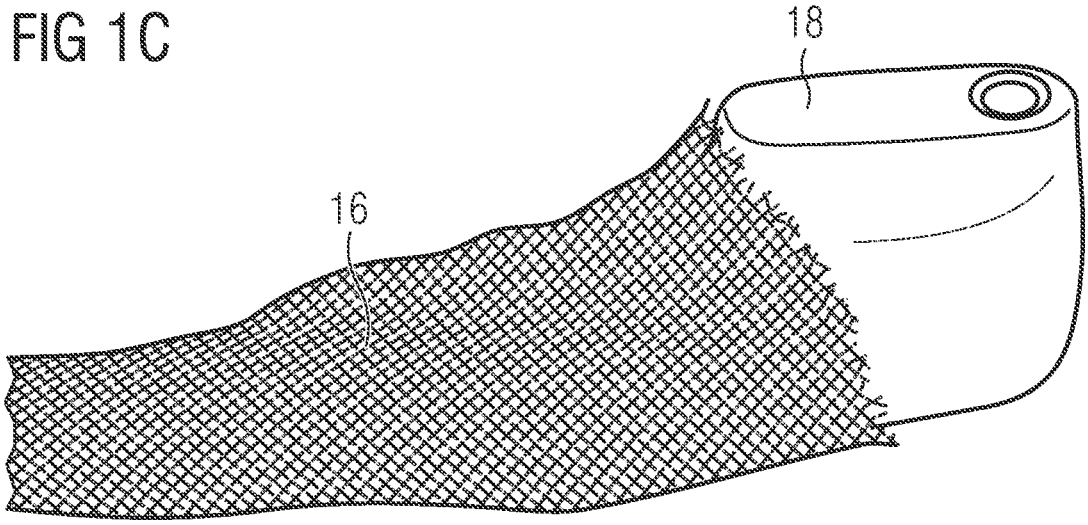
Figure 1D:
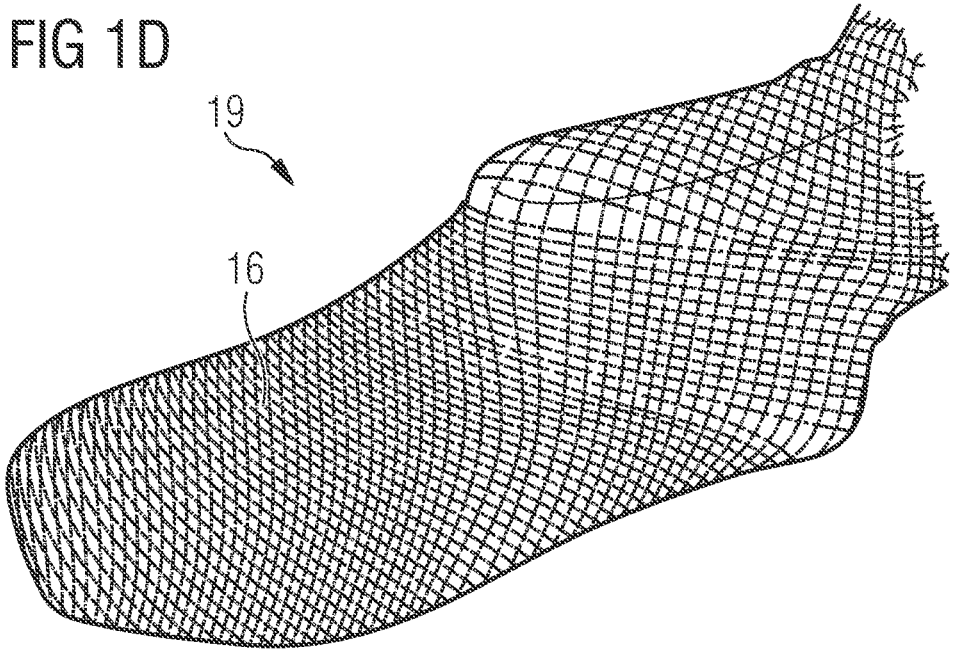

FIGS. 1C-D show how the braided tube 16 is arranged on a form 18. In this case, the form 18 is a shoe last and the component 19 shown in FIG. 1D is for a shoe upper. The method comprises sealing a first end, for example the toe end, of the first braided tube prior to arranging the first layer on the form, i.e. in the step shown in FIG. 1C. "Sealing" is to be understood as "closing". Sealing may comprise any suitable technique known in the art and any suitable technique disclosed herein such as, for example, heating, melting a meltable material, and dissolving a soluble portion.

The method further comprises conforming the component 19 to the shape of the shoe last 19. Conforming the component 19 to the shape of the shoe last 18 comprises heating a part of the component, for example by applying hot air or hot steam to the component 19.

The exemplary method further comprises sealing a second end, for example the heel end, of the first braided tube 16 after conforming the component 19 to the shape of the shoe last 18. This way, the shaped first braided tube 16 is consolidated. In other words, after sealing the second end of the first braided tube 16, the conformed shape of the first braided tube 16 becomes more permanent and stable. Sealing may comprise any suitable technique known in the art and any suitable technique disclosed herein such as, for example, heating, melting a meltable component, and dissolving a soluble portion.

FIG. 2A shows an exemplary shoe upper 20 comprising a component 19 produced as described with respect to FIGS. 1A-D. After the steps described with reference to FIGS. 1A-D above, the component 19 is removed from the last 18. A collar opening was cut into the component 19 to allow entry of a foot. A collar 23 was then attached to the component 19 around the collar opening to prevent unravelling of the yarns around the collar opening.

The braided element of the shoe upper 20 comprises a first braiding yarn 15*a* and a second braiding yarn 15*b*. The first braiding yarn 15*a* has a smaller cross-sectional area than the second braiding yarn 15*b*. The second braiding yarn 15*b* has a larger elastic modulus than the first braiding yarn 15*a*. Therefore, the second braiding yarn 15*b* allows regions of increased stiffness to be engineered in the shoe upper 20. In this example, a region of increased stiffness is created diagonally across the midfoot region in order to improve the stability provided to a foot of a wearer.

Figure 2B:
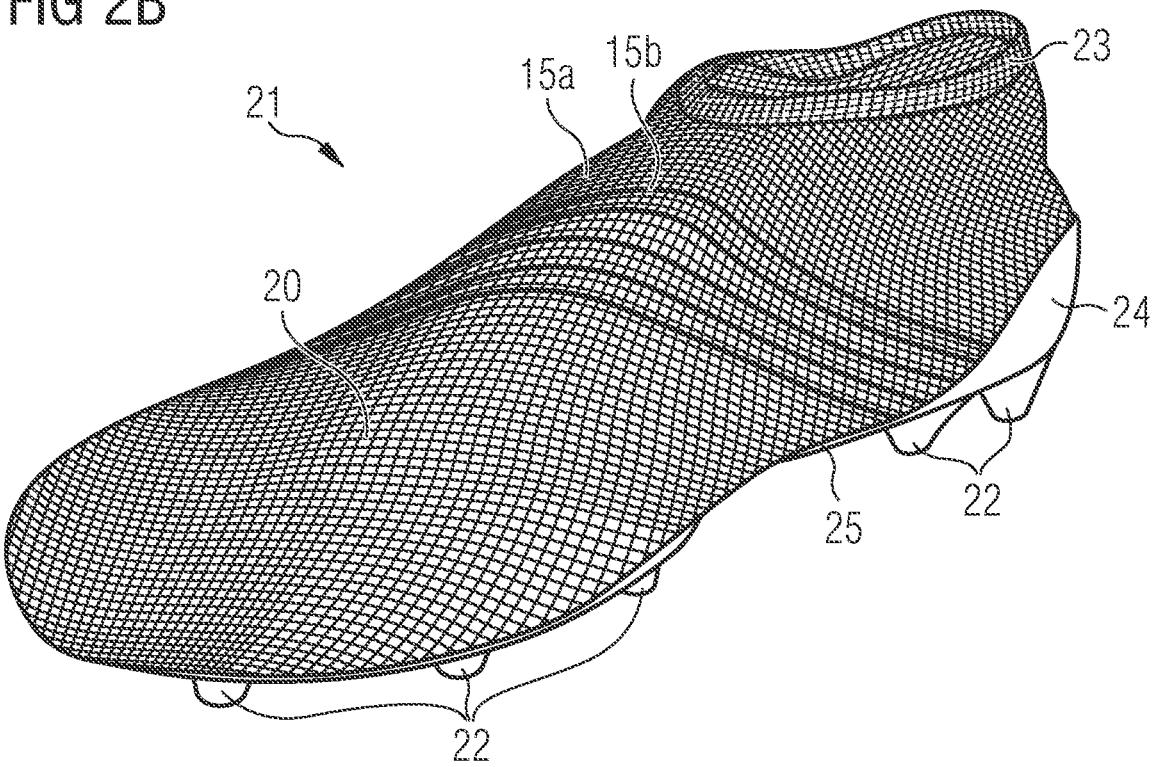

FIG. 2B shows an exemplary shoe 21 according to the present invention. The shoe 21 is formed by a method comprising: (a) forming a component 19 as exemplarily described above with respect to FIGS. 1A-D and FIG. 2A; (b) attaching a sole element 25. In this case, the component 19 makes up essentially the entire shoe upper 20. In this context, "essentially" means without additional elements such as the collar 23 and the heel counter 24. The shoe 21 is a football shoe, or football boot, that also comprises studs 22 for improved traction especially on soft, muddy ground.

FIG. 3 shows a measurement of the circumference 32 of a braided tube against the linear take-up speed 31 during production. The take-up speed 31 is determined by the take-up device of the braiding machine. Measurements were taken for several braided tubes. Each measured braided tube consisted of a single type of yarn. Three different types of yarn were tested: a first type 33 of yarn was coated yarn, a second type 35 of yarn comprises polyethylene terephthalate (PET) at a dernier value of 1336 dtex, and a third type 34 comprises a combination of 50% of the first type 33 and 50% of the second type 35. The measurements have shown that the tube circumference is greatest at a given take-up speed for yarns of the third type 35. The measurements have also shown that, generally, the greater the take-up speed, the greater the circumference of the relaxed braided tube. This measurement allows an informed choice of the parameters and settings during braiding in order to engineer a component with preferred properties.

FIGS. 4A-C illustrate a braiding angle 42 of a braided element 41 and a method for engineering the braiding angle 42. This is important, because the properties of the braided element 41 can be engineered, for example, by a suitable choice of yarn 15 and braiding angle 42. The braiding angle $\alpha$ 42 is the angle between a direction of the braiding yarns 15 and the braiding direction 44. A region with a low braiding angle, preferably between 15° and 45°, is radially easy to expand, and can allow for expansion during a dynamic movement. A region with a high braiding angle, preferably between 46° and 80°, on the other hand is radially less extensible and stiffer. At a very high braiding angle, the braided yarns are jammed in a non-axial direction. Jamming is the point at which there is no more natural expansion from a structural aspect of the braid and further expansion is linked to the strain of the filaments and yarns within it. This jamming can be used in regions where stability is required to complement or replace reinforcement structures. It is also evident from FIG. 4A, that a large braiding angle 42 generally implies a large braiding density.

The yarns 15 may have a non-circular cross-section, for example a lenticular shape. For example, the yarns 15 may have an ellipsoidal cross-section with a major axis 45 and a minor axis 46. A ribbon or a tape could also be used alternatively or additionally to a yarn. The diagonal lattice parameter 43 of the braided element 41 is shown in FIG. 4A.

FIG. 4B shows a first braided tube 16*a* and FIG. 4C shows a second braided tube 16*b*. The first braided tube 16*a* and the second braided tube 16*b* are generally identical, especially in the type of yarn that was used. However, the first braided tube 16*a* was formed at a take-up speed of 12 mm/s, while the second braided tube 16*b* was formed at a take-up speed of 18 mm/s, i.e. at a significantly higher take-up speed. The braiding angle 42, i.e. the angle between the braiding yarn 15 and the braiding direction 44, was measured for both the first braided tube 16*a* and the second braided tube 16*b* at a similar location. For the first braided tube 16*a*, the braiding angle 42*a* was found to be about 50°, while for the second braided tube 16*b*, the braiding angle 42*b* was found to be about 33°.

FIG. 5 shows another example of a shoe 21 according to the present invention. The shoe 21 comprises a heel counter 24 and a sole element 25. The shoe 21 further comprises a component comprising: a first layer L1, wherein the first layer L1 comprises a braided element 41*a*; and a second layer L2. A "braided element" may be a braided tube 16 produced by any method described herein. A "braided element" may be a braided tube that has been cut open so that the braided element does not necessarily have a tubular structure. The braided element 41*a* is braided biaxially.

The combination of a first layer L1 and a second layer L2 allows the functionality and comfort of the component to be improved. In this example, the first layer L1 is designed to provide good wearing comfort to the wearer, while the second layer L2 is designed to provide a strong "cage".

In this example, the first layer L1 and the second layer L2 overlap at at least one overlapping point 51. In this example, the first layer L1 and the second layer L2 overlap essentially over their entire surface. "Essentially" means in this context within manufacturing imperfections. This allows the properties of the first layer L1 and the second layer L2 to complement each other in a beneficial manner at the overlapping point 51.

In this example, the first layer L1 comprises a soluble portion that is soluble in a solvent and the method further comprises at least partly dissolving the soluble portion. At least partly dissolving the soluble portion comprises a suitable amount of solvent, determined by the solubility of the soluble portion in the solvent, to ensure that the soluble portion, when dissolved in the solvent, is not lost during the procedure but stays in contact with the first and/or second layer. In this case, enough solvent is provided to dissolve 80% of the soluble portion. Some loss, however, may be inevitable in practice.

In this example, the method comprises providing a coated yarn 41*a* comprising a coating that is soluble in the solvent and a core that is not soluble in the solvent. This way, the dissolved coating provides consolidation but the non-soluble core is not dissolved by the solvent. This improves the structural strength of the first layer L1.

In this example, the method comprises at least partly dissolving essentially the entire surface of the first layer L1 in order to consolidate the second layer L2. It is to be understood that not all of the soluble portion is dissolved, however, as explained above. This way, a particularly good stability of the component 21 can be achieved.

At least partly dissolving the soluble portion is done at temperatures of 70°-100° C. to increase the solubility of the soluble portion in the solvent.

The solvent in this example is water. Water is non-toxic and safe to use even on a large scale. The water-soluble coating of yarn 41*a* comprises poly(vinyl alcohol), which has the advantage that it is not toxic and has a high solubility in water. The upper may be provided with a water-proof coating to protect the water-soluble materials in the finished upper during use.

In this example, the second layer L2 comprises a second braided element 41*b*. Incorporating a second braided element 41*b* is advantageous as it allows different requirements for different parts of the component of the shoe 21 to be satisfied.

In this example, the first braided element of the first layer L1 comprises a first braiding angle at the overlapping point 51, the second braided element of the second layer L2 comprises a second braiding angle at the overlapping point 51, and the first braiding angle 42*a* may be different than the second braiding angle 42*b*. The braiding angle strongly affects the ability of a braided tube or element to expand and thus the stiffness of the tube or element and the support that a component would provide, for example to a foot. The braiding angle also affects the perceived level of comfort in wearing an article of footwear or apparel that comprises a component according to the present invention.

In this example, the first braiding angle 42*a* is larger than the second braiding angle 42*b*. For a given type of yarn, the first braided tube with the first braiding angle 42*a* would be less expandable and stiffer than the second braided tube with the (smaller) second braiding angle 42*b*. However, the first braided element 41*a* comprises a first yarn of a first type and the second braided element 41*b* comprises a second yarn of a second type. The type of yarn, in the present context, is determined by the properties of the yarn, comprising, for example, composition, tex value, elasticity, bending stiffness, coating, cross-sectional area, and melt yarn content.

The first yarn of the first type has a first elastic modulus and the second yarn of the second type has a second elastic modulus, and the second elastic modulus is greater than the first elastic modulus. A material with a large elastic modulus requires a large force along a direction for an extension by a unit distance along the direction. As the second elastic modulus is greater than the first elastic modulus, it is possible, to compensate for the greater stiffness that would, generally, be afforded by the first braiding angle 42*a* being larger than the second braiding angle 42*b*. Thus, it is possible that the first braided element 41*a*, i.e. the first layer L1, is less stiff than the second braided element 41*b*, i.e. the second layer L2, even though the first braiding angle 42*a* is larger than the second braiding angle 42*b*.

Alternatively, the first elastic modulus may be greater than the second elastic modulus. This way it would, for example, be possible to enhance the effect due to a first braiding angle 42*a* that is larger than a second braiding angle 42*b*.

In this example, the second layer L2 is arranged above the first layer. "Above" in the context of the present invention means closer to the outside of the article of footwear or apparel. In this arrangement, the first layer L1 provides wearing comfort to the wearer, while the second layer L2 provides the required stability or level of water resistance. The first layer L1 may, for example, comprise a finer and/or softer yarn than the yarn comprised in the second layer L2 in order to provide a comfortable feel on the skin of a wearer.

Figure 6:
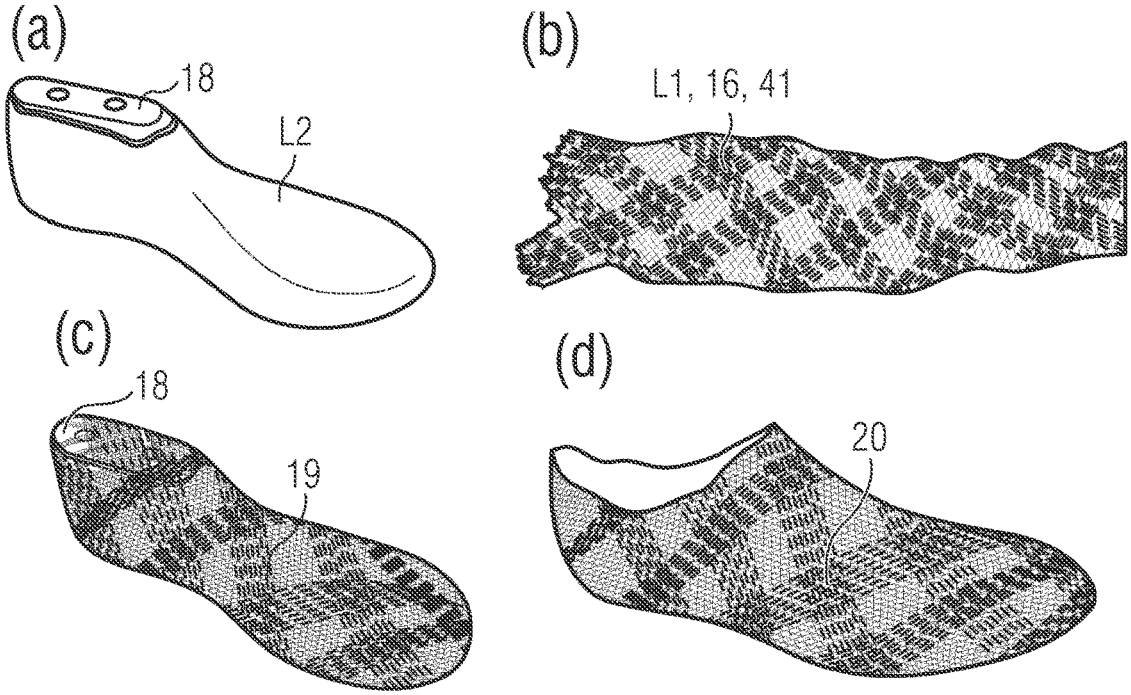

FIG. 6 shows an exemplary shoe upper 20 and illustrates a method for manufacturing the same, according to the present invention.

This shoe upper 20 comprises a component, comprising: a first layer L1, wherein the first layer L1 comprises a braided element 41 and a second layer L2.

This example, the second layer L2 comprises a non-woven. In the context of the present invention, a non-woven, or nonwoven, is any material comprising fibres that are bonded together by chemical, mechanical, or thermal means, excluding woven or knitted materials. The non-woven may be formed by any known method, for example by the spun-bond or meltblown methods. A non-woven may be lightweight, breathable, and offer good water resistance. However, non-wovens may tear easily due to their low tensile strength. The combination of the first braided element 41 and the second layer L2 comprising a non-woven therefore allows the properties of a braided element 41, in particular its good tensile strength, and the properties of a non-woven, in particular its good level of water resistance, i.e. a low water permeability, to be combined advantageously.

The second layer L2 comprises a thermoplastic. Thermoplastic, in the context of the present invention, is any polymer that becomes pliable above a specific temperature and hardens upon cooling below that temperature. Thermoplastic may be useful for forming a non-woven, as it allows the fibres of the non-woven to be bonded together by thermal means, such as heating and subsequent cooling. A thermoplastic may also be useful in order to aid conforming the component 19 to the shape of the form 18, for example by thermal means.

The shoe upper 20 is formed in a four-step process. In a first step (a), a shoe last 18 is coated with fibres comprising a thermoplastic. The fibres are melted and thus form the non-woven layer L2. In the second step (b), a braided tube 16 is braided as described herein. In the third step (c) a component 19 is formed by arranging the braided tube 16 on the shoe last 18. The shape of the component 19 is consolidated by heating the component 19 on the last 18 and subsequently allowing the component 19 to cool down. This consolidation also bonds the first layer L1 securely to the second layer L2. In the fourth step (d), the shoe upper 20 comprising the first layer L1 and the second layer L2 is removed from the last 18.

In this example, the first layer L1 is connected to the second layer L2 over essentially the entire outer surface of the second layer. The second layer L2 comprises a meltable, thermoplastic, material. The first layer L1 and the second layer L2 have been connected by melting the meltable material and allowing it to cool and solidify. Alternatively, or additionally the first layer L1 may comprise a meltable material, for example a fuse yarn.

Thus, in this example, the second layer L2 is arranged below the first layer. "Below" in the context of the present invention means closer to the inside of the article of footwear or apparel. In this arrangement, the second layer L2 provides wearing comfort to the wearer, while the first layer L1 provides structural stability, for example tensile strength. The non-woven second layer L2 is comfortable to wear on the skin, while the first layer, comprising the first braided element 41, provides tensile strength. The first layer L1 may also serve as protection against abrasion, for example by using strong, abrasion-resistant yarn in the first braided element 41.

Figure 7:
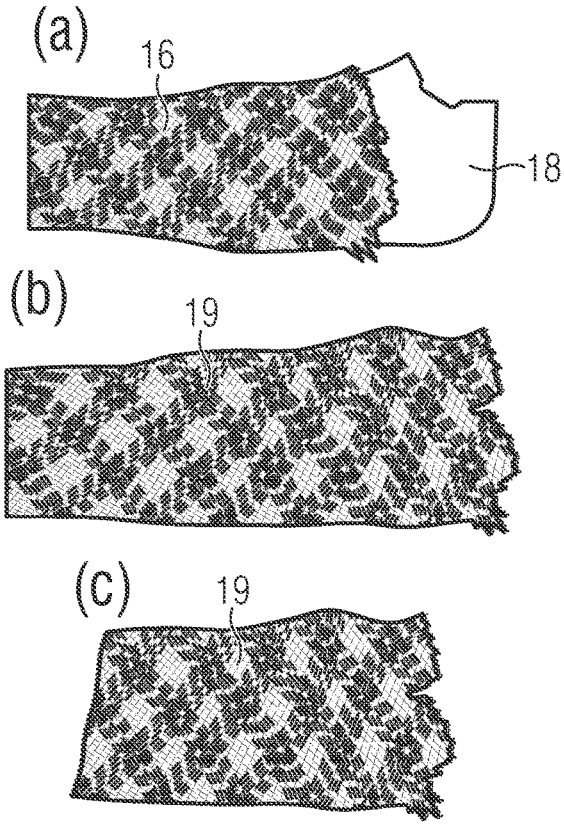

FIG. 7 shows an exemplary method of producing a component 19 for an article of footwear or apparel according to the present invention. In this example, a braided tube 16 is produced on a braiding machine as described herein. In step (a), the braided tube 16 is then pulled over a form 18. Here, the form 18 has a blade-like shape. That is, the form 18 is not a shoe last. Instead, the form 18 is significantly flatter than a shoe last. In step (b), the component 19 is consolidated while it is arranged on the form 18. In this example, the consolidation is performed by attaching hot-melt patches in specific regions of the component 19 and consolidating the component 19 using a hot press or bladder. The component 19 is then allowed to cool and is removed in step (c) from the form 18. The inventors have found that it is easier to automate this process for a form 18 that is flatter than the shoe last, as the process may be automated using patch-placement techniques, which are easier to implement on a substantially flat surface, rather than on a three-dimensional shoe last.

FIG. 8A shows an exemplary shoe upper 20 according to the present invention. The upper 20 was produced by a method, comprising: forming at least a first layer by braiding a first braided tube, wherein braiding is performed with an empty braiding center; and arranging the first layer on a form. In this example, the form was a shoe last. The exemplary upper 20 was consolidated on the form and then removed from the form.

An advantage of the present invention is that a shoe upper 20 formed by a method according to the present invention is "naturally" stiffer in a heel region 63, where more support is required, than in a toe region 61, where more flexibility is usually desired. The reason for this is that when the first braided tube is pulled over the shoe last, the braided tube is stretched most in the heel region of the upper to conform to the geometry of the last thus increasing the braiding angle in the heel region 63 and hence increasing the stiffness in the heel region 63.

FIG. 8B shows the elasticity measured in the heel region 63, or rearfoot region 63, the midfoot region 62, and the forefoot region 61, or toe region 61. The vertical axis 65 shows the load in Newton, in other words the applied force. Note that for simplicity the force was not normalized per unit area to yield stress. The horizontal axis 64 shows the extension from equilibrium in mm. Both the force and the displacement were measured in a radial direction. The measurement clearly shows that a greater force is required, for any extension greater than 2 mm from equilibrium, to extend the upper 20 in the rear foot region 63 than in the midfoot region 62 or the forefoot region 61. Based on the insights provided herein, it is therefore possible to design and engineer a shoe upper with optimal properties for a given application.

Some embodiments described herein relate to a method of producing a component for an article of footwear or apparel, or a sporting goods accessory, including forming at least a first layer by braiding a first braided tube, wherein braiding is performed with an empty braiding center, and arranging the first layer on a form. In some embodiments, the method includes forming a second layer and arranging the second layer on the form. In some embodiments, the method further includes overlapping the first layer and the second layer at at least one overlapping point. In some embodiments, the second layer includes a second braided tube, and the first braided tube includes a first braiding angle at the overlapping point, the second braided tube includes a second braiding angle at the overlapping point, and the first braiding angle is different than the second braiding angle. In some embodiments, the first braiding angle is larger than the second braiding angle. In some embodiments, the first braided tube includes a first yarn of a first type and the second braided tube includes a second yarn of a second type. In some embodiments, the first yarn of the first type has a first elastic modulus and the second yarn of the second type has a second elastic modulus, and the second elastic modulus is greater than the first elastic modulus.

In some embodiments, the second layer includes a nonwoven. In some embodiments, the second layer includes a thermoplastic. In some embodiments, the second layer is arranged above the first layer. In some embodiments, the second layer is arranged below the first layer.

Some embodiments described herein relate to a component for an article of footwear or apparel, or a sporting goods accessory, including a first layer that includes a first braided element, and a second layer. In some embodiments, the component is a portion of a shoe upper. In some embodiments, the first braided element is braided biaxially. In some embodiments, the first layer and the second layer overlap at at least one overlapping point. In some embodiments, the first layer is connected to the second layer at at least one connection point. In some embodiments, the first layer and/or the second layer includes at least one meltable material at the at least one connection point. In some embodiments, the first layer and/or the second layer includes a soluble portion that is at least partly soluble in a solvent.

In some embodiments, the first layer and the second layer overlap at at least one overlapping point, the first braided element includes a first braiding angle at the overlapping point, the second braided element includes a second braiding angle at the overlapping point, and the first braiding angle is different than the second braiding angle. In some embodiments, the first braiding angle is larger than the second braiding angle. In some embodiments, the second layer is arranged below the first layer.

REFERENCE SIGNS

11: braiding machine
12: yarn package
13: braiding center
14: take-up device
15: braiding yarn
16: braided tube
17: braiding ring
18: form
19: component
20: shoe upper
21: shoe
22: studs
23: collar
24: heel counter
25: sole element
31: linear take-up speed
32: relaxed braid circumference
33: coated yarns
34: combination yarn
35: 1336 dtex PET yarns
41: braided element
42: braiding angle
43: diagonal lattice parameter
44: braiding direction
45: length of major axis
46: length of minor axis
L1: first layer
L2: second layer
51: overlapping point
61: forefoot region
62: midfoot region
63: heel region
64: extension
65: load

What is claimed is:

1. A component for an article of footwear or apparel, or a sporting goods accessory, comprising:

a first layer, wherein the first layer comprises a first braided element; and a second layer, wherein the first braided element comprises a biaxially braided tube, wherein the second layer comprises a second braided element, wherein the first braided element comprises a first braiding angle at an overlapping point with the second braided element, and the second braided element comprises a second braiding angle at the overlapping point different than the first braiding angle, and wherein the first braiding angle is greater than the second braiding angle.

2. The component according to claim 1, wherein the first braided element comprises a first yarn of a first type and the second braided element comprises a second yarn of a second type.

3. The component according to claim 2, wherein the first yarn of the first type has a first elastic modulus and the second yarn of the second type has a second elastic modulus, and wherein the second elastic modulus is greater than the first elastic modulus.

4. The component according to claim 1, wherein the second layer comprises a thermoplastic material.

5. The component according to claim 1, wherein the second layer is arranged above the first layer.

6. A shoe, comprising: a component according to claim 1, and a sole element.

7. The component according to claim 1, wherein the first braiding angle is between 46 degrees and 80 degrees, and the second braiding angle is between 15 degrees and 45 degrees.

8. The component according to claim 1, wherein the first braiding angle provides the first braided element with a first stiffness, and the second braiding angle provides the second braided element with a second stiffness less than the first stiffness.

9. The component of claim 1, wherein the biaxially braided tube does not have an axial yarn.

10. The component according to claim 1, wherein the component is a shoe upper.

11. The component according to claim 1, wherein the biaxially braided tube has a sealed end and an open end opposite the sealed end.

12. The component according to claim 1, wherein the second layer is arranged below the first layer.

13. The component according to claim 1, wherein the second braided element comprises a second biaxially braided tube.

14. A component for an article of footwear or apparel, or a sporting goods accessory, comprising:

a first layer, wherein the first layer comprises a first braided element; and a second layer, wherein the first braided element comprises a biaxially braided tube, wherein the second layer comprises a second braided element, wherein the first braided element comprises a first braiding angle at an overlapping point with the second braided element, and the second braided element comprises a second braiding angle at the overlapping point different than the first braiding angle, and wherein the first braiding angle provides the first braided element with a first stiffness, and the second braiding angle provides the second braided element with a second stiffness less than the first stiffness.

* * * * *